US008656833B2

(12) United States Patent
Lai

(10) Patent No.: US 8,656,833 B2
(45) Date of Patent: Feb. 25, 2014

(54) LEVELING MACHINE FOR ROLLED-UP TABLETS

(76) Inventor: Steven Lai, Taichung (TW)

( * ) Notice: Subject to any disclaimer, the term of this patent is extended or adjusted under 35 U.S.C. 154(b) by 350 days.

(21) Appl. No.: 13/241,185

(22) Filed: Sep. 22, 2011

(65) Prior Publication Data

US 2013/0074713 A1 Mar. 28, 2013

(51) Int. Cl.
*D21G 1/00* (2006.01)

(52) U.S. Cl.
USPC ..... 100/163 R; 100/155 R; 100/161; 100/162 R; 100/164; 100/162 B; 100/168; 100/169; 100/170; 100/172

(58) Field of Classification Search
USPC ..... 100/155 R, 161, 162 R, 163 R, 164, 100/162 B, 168, 169, 170, 172
See application file for complete search history.

(56) References Cited

U.S. PATENT DOCUMENTS 3,132,581 A * 5/1964 Isbey et al. ..... 100/171
3,704,022 A * 11/1972 Blattry et al. ..... 279/121
3,901,758 A * 8/1975 Humphries ..... 156/499
3,943,031 A * 3/1976 Krueger et al. ..... 156/583.1
5,057,860 A * 10/1991 Suzuki ..... 399/279
5,738,007 A * 4/1998 Roerig et al. ..... 100/327
6,085,646 A * 7/2000 Lauterbach et al. ..... 100/163 R
6,368,458 B1 * 4/2002 Graf et al. ..... 162/206
7,314,191 B2 * 1/2008 Nikam ..... 241/222

* cited by examiner

*Primary Examiner* — Shelley Self
*Assistant Examiner* — Onekki Jolly
(74) *Attorney, Agent, or Firm* — Rabin & Berdo, P.C.

(57) ABSTRACT

A leveling machine for rolled-up tablets has a base, a mounting frame and a wheel-leveling device. The base has two sideboards faced each other and each sideboard has a spindle hole. The mounting frame is rotatably mounted in the base between the sideboards and has a spindle, an adjusting motor, two mounting boards and a bottom cylinder. The spindle is rotatably mounted in the spindle holes of the sideboards. The adjusting motor is mounted securely on the corresponding sideboard to drive the spindle. The mounting boards are respectively, obliquely and securely mounted around the spindle near the sideboards. The bottom cylinder is rotatably mounted around the spindle between the mounting boards. The wheel-leveling device is connected to the mounting frame and has two top cylinder mounts, a cylinder, a top cylinder, two pushing mounts and two telescopic drivers.

5 Claims, 9 Drawing Sheets

LEVELING MACHINE FOR ROLLED-UP TABLETS

BACKGROUND OF THE INVENTION

1. Field of the Invention

The present invention relates to a leveling machine, and more particularly to an adjustable leveling machine for rolled-up tablets to provide a preferred leveling effect for the rolled-up tablets.

2. Description of Related Art

A conventional leveling machine for rolled-up tablets has two sideboards, a bottom cylinder, a mounting frame and multiple bearings. The sideboards face to each other at an interval. The bottom cylinder is rotatably mounted between the sideboards. The mounting frame is mounted between the sideboards over the bottom cylinder. The bearings are rotatably mounted on the mounting frame at intervals to be rotors. A rolled-up tablet such as a paper or a film is moved and pressed between the bottom cylinder and the bearings to level the roll-up tablet to become a flat tablet.

However, the bearings of the conventional leveling machine separately abut the bottom cylinder, and this cannot provide an average clamping force to the rolled-up tablet and the surface of bottom cylinder may be damaged by the bearings. In addition, when the bearings are rotated at a high speed, the temperature of the bearing may be increased and the lubricating oil in the bearings may flow out of the bearings and this will damage the rolled-up tablet. Furthermore, the positions of the bearings are fixed and cannot be adjusted, and this cannot level the rolled-up tablets with different rolled-up degrees.

The invention provides a leveling machine for rolled-up tablets that mitigates or obviates the aforementioned problems.

SUMMARY OF THE INVENTION

The main objective of the present invention is to provide a leveling machine for rolled-up tablets that can be adjusted the rolling position of the leveling machine to provide a preferred leveling effect for the rolled-up tablets.

The leveling machine for rolled-up tablets in accordance with the present invention has a base, a mounting frame and a wheel-leveling device. The base has two sideboards faced each other and each sideboard has a spindle hole. The mounting frame is rotatably mounted in the base between the sideboards and has a spindle, an adjusting motor, two mounting boards and a bottom cylinder. The spindle is rotatably mounted in the spindle holes of the sideboards. The adjusting motor is mounted securely on the corresponding sideboard to drive the spindle. The mounting boards are respectively, obliquely and securely mounted around the spindle near the sideboards. The bottom cylinder is rotatably mounted around the spindle between the mounting boards. The wheel-leveling device is connected to the mounting frame and has two top cylinder mounts, a cylinder, a top cylinder, two pushing mounts and two telescopic drivers. The top cylinder mounts are respectively and rotatably mounted on the mounting boards. The cylinder axle is connected to the top cylinder mounts at the rear ends over the bottom cylinder. The top cylinder is rotatably mounted around the cylinder axle and selectively abuts the bottom cylinder. The pushing mounts are respectively mounted on the mounting boards. The telescopic drivers are respectively and securely mounted on the pushing mounts and each telescopic driver has an abutting rod abutting a corresponding cylinder mount.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
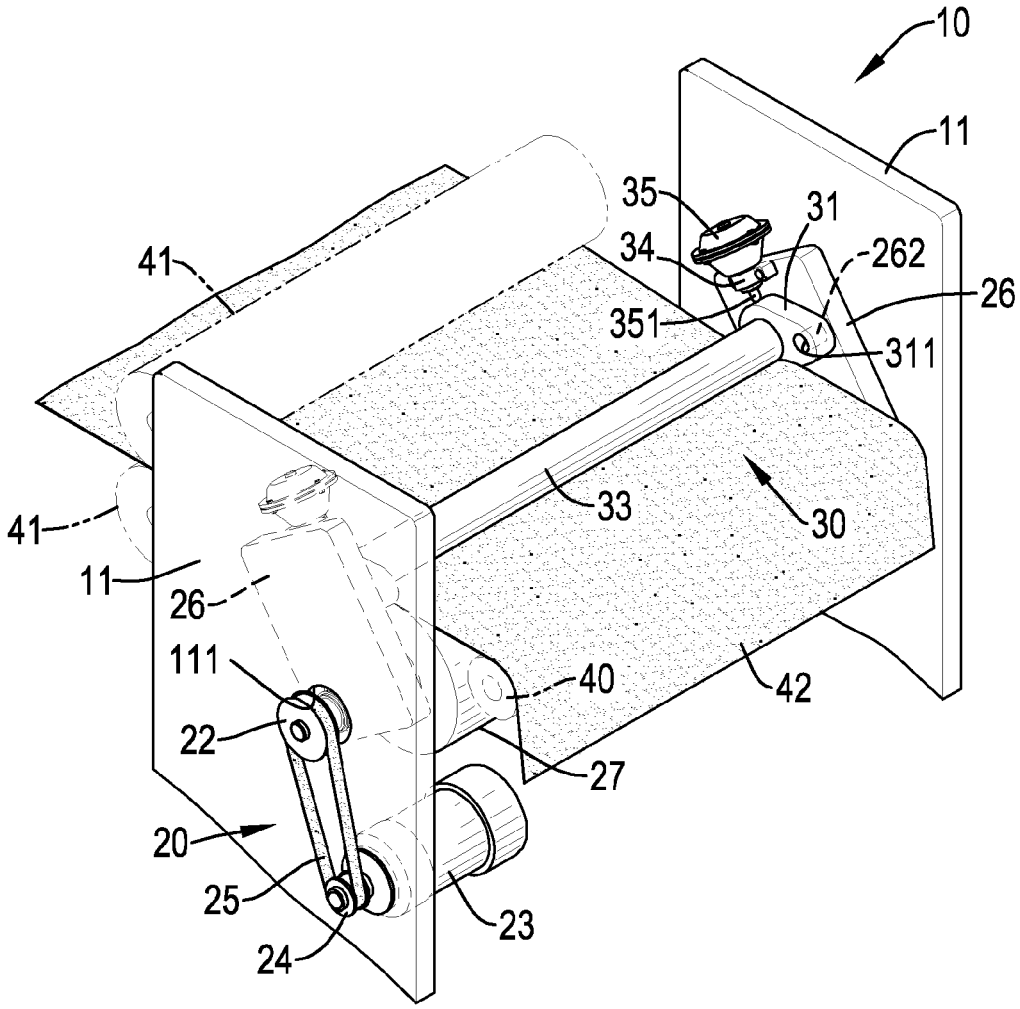
FIG. 1 is a perspective view of a first embodiment of a leveling machine for rolled-up tablets in accordance with the present invention.
Figure 2:
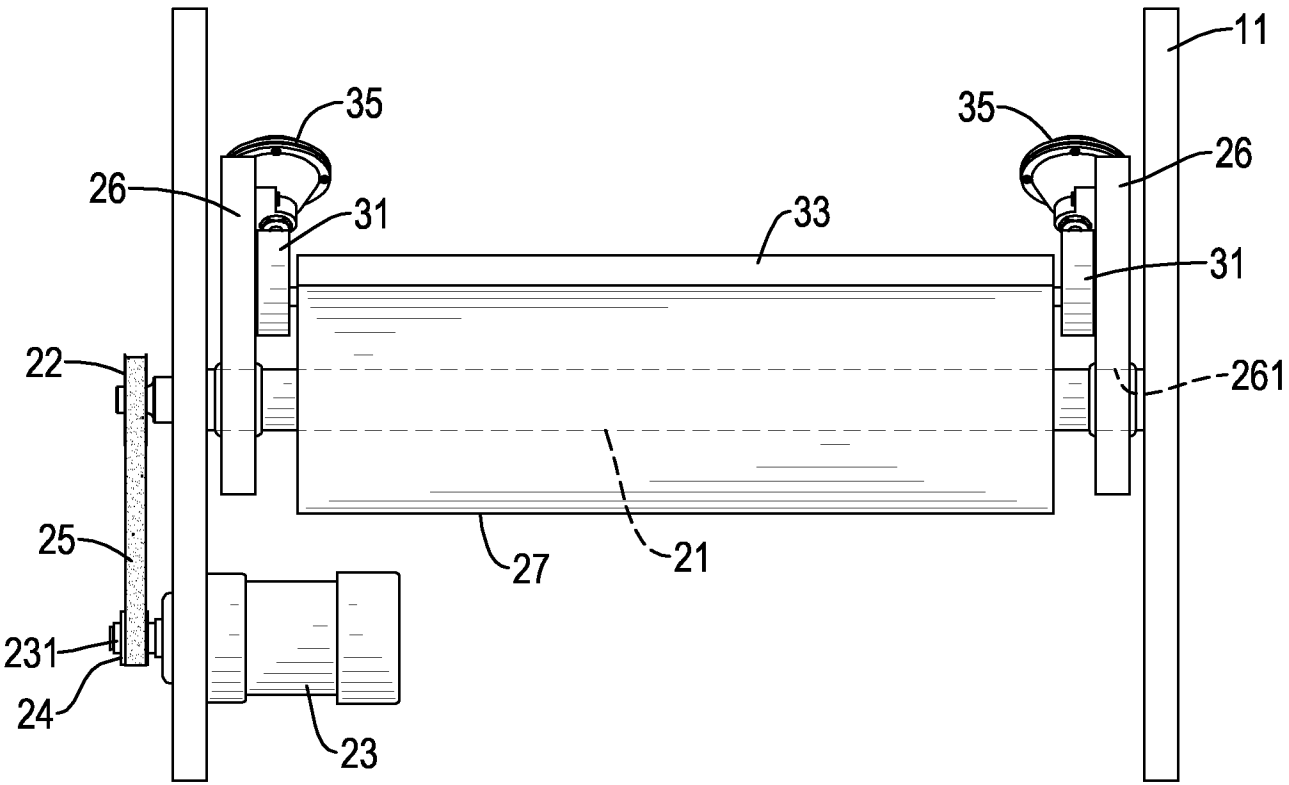
FIG. 2 is a front view of the leveling machine for rolled-up tablets in FIG. 1.
Figure 3:
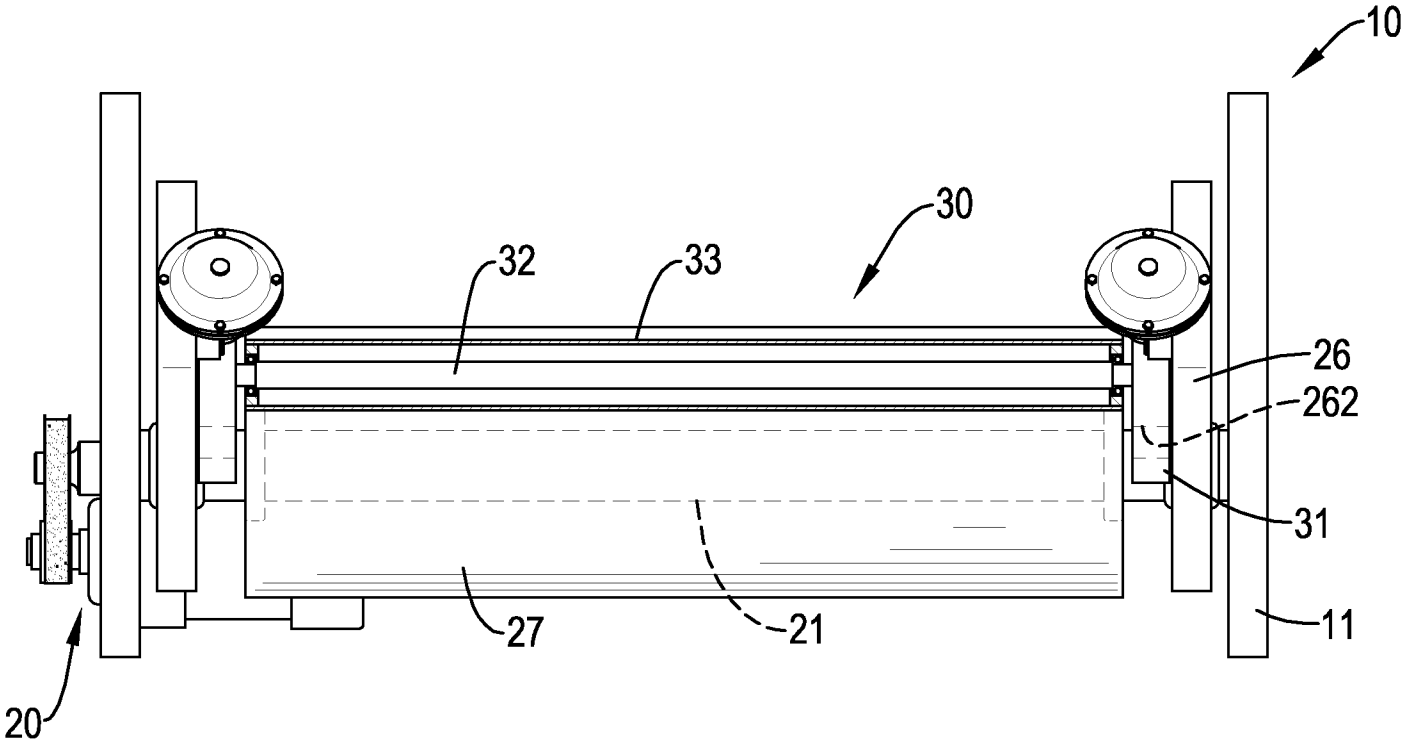
FIG. 3 is a top view of the leveling machine for rolled-up tablets in FIG. 1.

With reference to FIGS. 1 to 4, a first embodiment of a leveling machine for rolled-up tablets in accordance with the present invention comprises a base 10, a mounting frame 20 and a wheel-leveling device 30.

The base 10 has two sideboards 11. The sideboards 11 are rectangular and face to each other at an interval, and each sideboard 11 has an inner side, an outer side and a spindle hole 111. The inner sides of the sideboards 11 face to each other. The spindle hole 111 is formed through the sideboard 11 and aligns with the spindle hole 111 of the other sideboard 11.

The mounting frame 20 is rotatably mounted in the base 10 between the sideboards 11 and has a spindle 21, an adjusting belt pulley 22, an adjusting motor 23, a driving belt pulley 24, a belt 25, two mounting boards 26 and a bottom cylinder 27.

The spindle 21 is rotatably mounted in the spindle holes 111 of the sideboards 11 and has two ends. One of the ends of the spindle 21 extends out of the outer side of a corresponding sideboard 11. The adjusting belt pulley 22 is mounted around the end of the spindle 21 that extends out of the corresponding sideboard 11. The adjusting motor 23 may be a servomotor, is mounted securely on the corresponding sideboard 11 below the spindle 21 and has a driving axle 231. The driving axle 231 extends out of the corresponding sideboard 11 below the end of the spindle 21 that extends out of the corresponding sideboard 11. The driving belt pulley 24 is mounted around the driving axle 231 of the adjusting motor 23 below the adjusting belt pulley 22. The belt 25 is mounted around the belt pulleys 22, 23 to enable the adjusting motor 23 to drive the spindle 21 to rotate. In addition, the driving axle 231 of the adjusting axle 23 can be directly connected to the spindle 21 to drive the spindle 21.

The mounting boards 26 are rectangular, are respectively, obliquely and are securely mounted around the spindle 21 near the inner sides of the sideboards 11, and each mounting board 26 has a bottom, a top, an inner side, a mounting hole 261 and a oscillating rod 262. The inner sides of the mounting boards 26 face to each other. The mounting holes 261 are respectively formed through the mounting boards 26 near the bottoms of the mounting boards 26 and are securely mounted around the spindle 21. The oscillating rods 262 are respectively formed on and protrude from the inner sides of the mounting boards 26 near the tops of the mounting boards 26 and align with each other. The bottom cylinder 27 is soft and is rotatably mounted around the spindle 21 between the mounting boards 26 and has a diameter. Then, the angles of the mounting boards 26 relative to the bottom cylinder 27 can be changed by the spindle 21.

Figure 6:
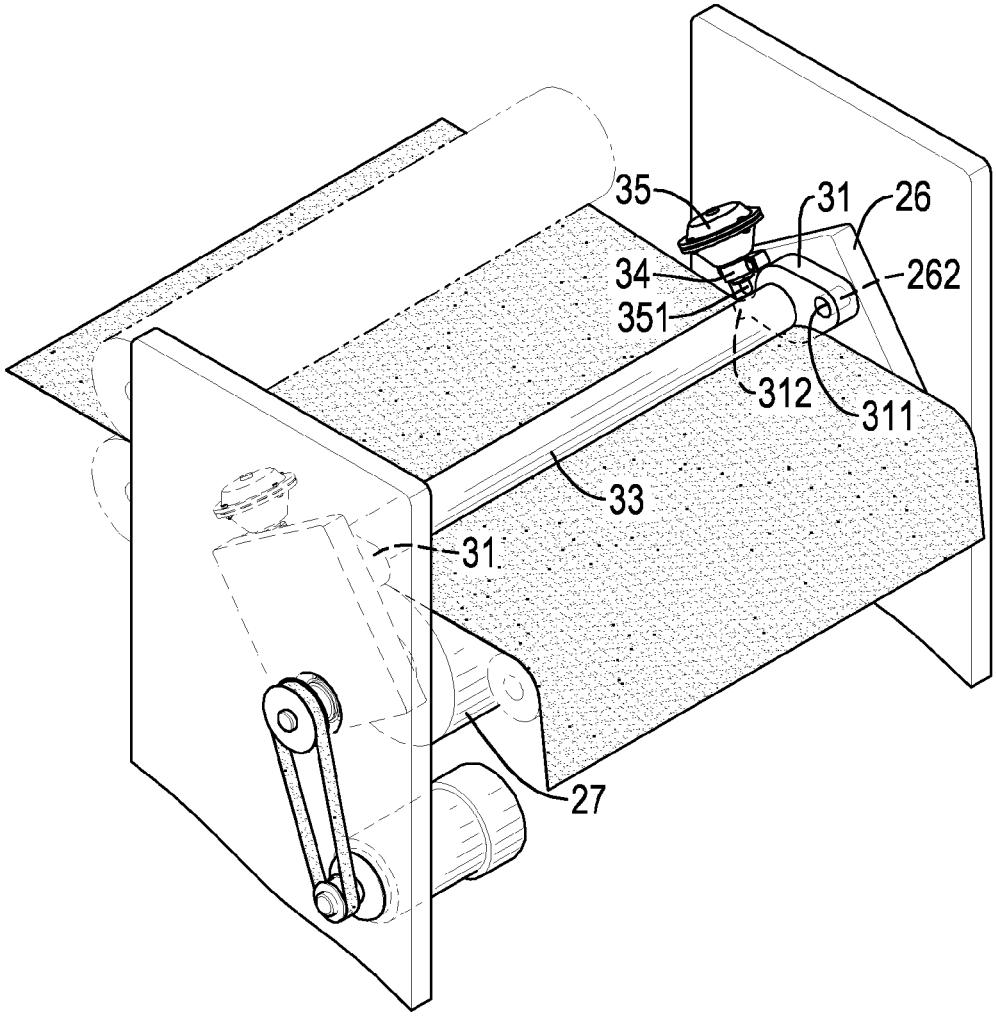
FIG. 6 is a perspective view of a second embodiment of a leveling machine for rolled-up tablets in accordance with the present invention.
Figure 7:
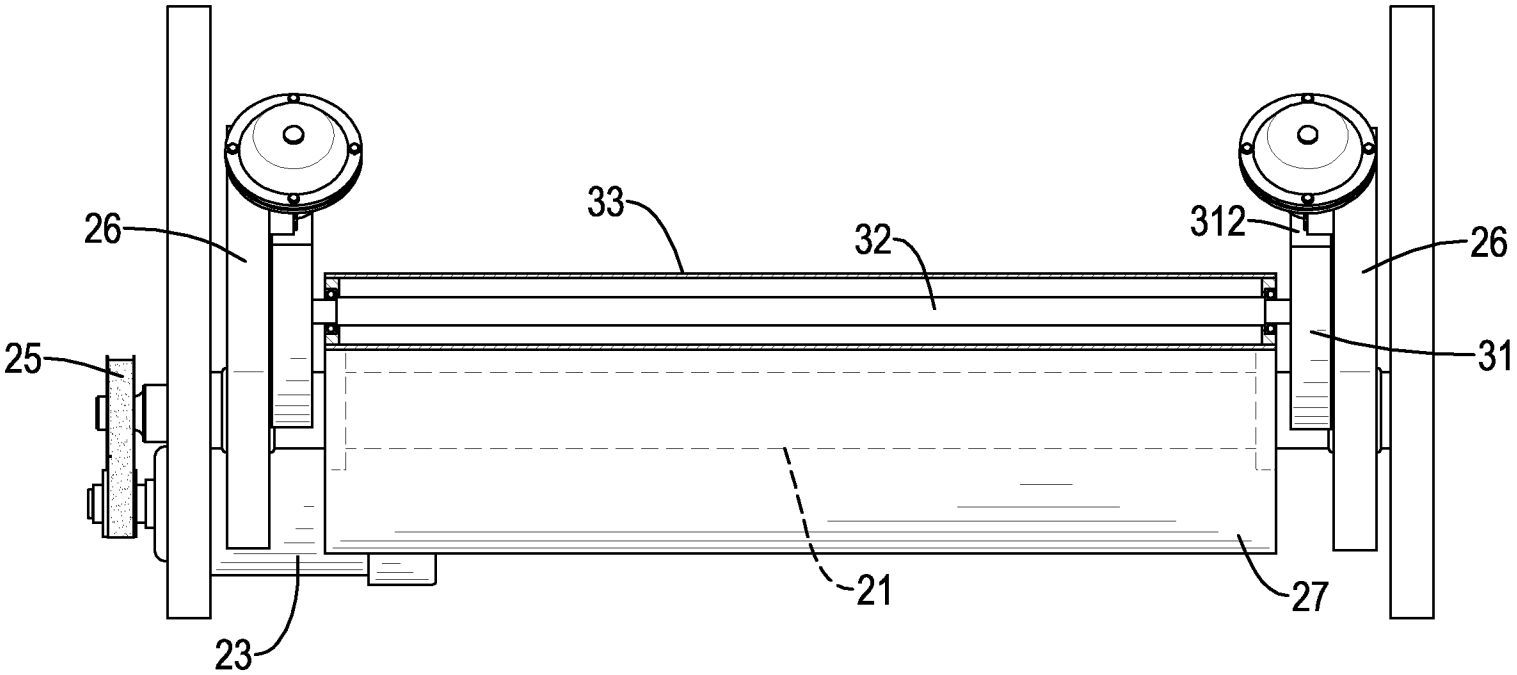
FIG. 7 is a front view of the leveling machine for rolled-up tablets in FIG. 6.

The wheel-leveling device 30 is connected to the mounting frame 20 and has two top cylinder mounts 31, a cylinder 32, a top cylinder 33, two pushing mounts 34 and two telescopic drivers 35. The top cylinder mounts 31 are noncircular and are respectively and rotatably mounted on the oscillating rods 262 of the mounting boards 26, and each cylinder mount 31 has a front end, a rear end, an outer side, an inner side, an annular surface and a rod hole 311. The rod hole 311 is formed in the outer side of the cylinder mount 31 at the front end and is mounted around the oscillating rod 262 of a corresponding mounting board 26 to enable the rear end of the cylinder mount 31 to extend to the bottom cylinder 27. Furthermore, the top cylinder mounts 31 also can be movably mounted on the mounting boards 26 by rails without using the oscillating rods 262 and the rod holes 311 to enable the top cylinder mounts 31 to move relative to the bottom cylinder 27. top cylinder mounts With further reference to FIGS. 6 to 8, a second embodiment of a leveling machine for rolled-up tablets in accordance with the present invention has a similar structure as the first embodiment of the a leveling machine for rolled-up tablets in accordance with the present invention, except each cylinder mount 31 further has a lever segment 312. The lever segment 312 is formed on and protruding from the rear end of the cylinder mount 31 and abuts the abutting rod 351 of a corresponding telescopic driver 35 to enable the top cylinder 33 to press against the bottom cylinder 27.

The cylinder axle 32 is connected to the inner sides of the top cylinder mounts 31 at the rear ends over the bottom cylinder 27. The top cylinder 33 is rotatably mounted around the cylinder axle 32, selectively abuts the bottom cylinder 27 and has a diameter smaller than the diameter of the bottom cylinder 27. The pushing mounts 34 are respectively mounted on the inner sides of the mounting boards 26 at the tops of the mounting boards 26, and each pushing mount 34 has a top and a bottom.

The telescopic drivers 35 are respectively and securely mounted on the tops of the pushing mounts 34, and each telescopic driver 35 has a bottom and an abutting rod 351. The abutting rod 351 is movably mounted on the bottom of the telescopic driver 35, extends out of the bottom of the corresponding pushing mount 34 and abuts the annular surface at the rear end of the corresponding cylinder mount 31 to enable the top cylinder 33 to abut the bottom cylinder 27. An imaginary line that extends along the abutting rod 351 passes through another imaginary line extended by an axle center of the top cylinder 33. Then, the abutting rods 351 of the telescopic drivers 35 can push the top cylinder mounts 31 to enable the top cylinder 33 to press against the bottom cylinder 27.

With reference to FIGS. 1, 4, 6 and 8, when using the leveling machine for rolled-up tablets in accordance with the present invention, a guiding cylinder 40 is rotatably mounted in front of the bottom cylinder 27 and two transporting cylinders 41 are rotatably mounted in the rear of the base 10 at opposite rotating directions to enable a rolled-up tablet 42 such as a paper or a film to move into the leveling machine from the guiding cylinder 40 to the transporting cylinders 41. When the rolled-up tablet 42 moves on the guiding cylinder 40, the free side of the rolled-up tablet 42 moves between the bottom cylinder 27 and the top cylinder 33. The cylinders 27, 33 are rotated at opposite directions to level the roller-up tablet 42 to become a flat tablet. After the cylinders 27, 33 press the rolled-up tablets 42, the flat tablet moves out of the level machine by the transporting cylinders 41. During the leveling process, the rolled-up tablet 42 can be pressed by the cylinders 27, 33 at opposite rotating directions to become the flat tablet 42.

When the level machine is used to level the rolled-up tablet 42, the clamping force between the top cylinder 33 and the bottom cylinder 27 near the sideboards 11 can be adjusted by driving the abutting rods 351 of the telescopic drivers 35 to move upwardly or downwardly to push the rear ends or the lever segments 312 of the top cylinder mounts 31. Then, the cylinders 27, 33 can be contacted closely to roll the rolled-up tablet 42 up with different clamping force. In addition, the cylinders 27, 33 are contacted with each other closely and this can provide an average clamping force to the rolled-up tablets 42. Furthermore, the level machine in accordance with the present invention uses the cylinders 27, 31 to level the roller-up tables 42 without using the rotors with bearings and this can prevent the oil leaking from the bearings to damage the rolled-up tablets 42 and also can avoid the bottom cylinder 27 from breaking.

With reference to FIGS. 1, 2, 5, 6 and 9, when the level machine in accordance with the present invention is used to level a rolled-up tablet 42 with a slight rolled-up degree, the adjusting motor 23 is driven to rotate the spindle 21 via the driving belt pulley 24, the belt 25 and the adjusting belt pulley 22 to enable the mounting boards 26 to oscillate forwardly. Then, the top cylinders 33 are moved forwardly to over the center of the bottom cylinder 27, and the rolled-up tablet 42 with a slight rolled-up degree can be pressed between the top cylinders 33 and the bottom cylinder 27 with a slight reversed clamping force and this can prevent the rolled-up tablet 42 from leveling overly.

Figure 4:
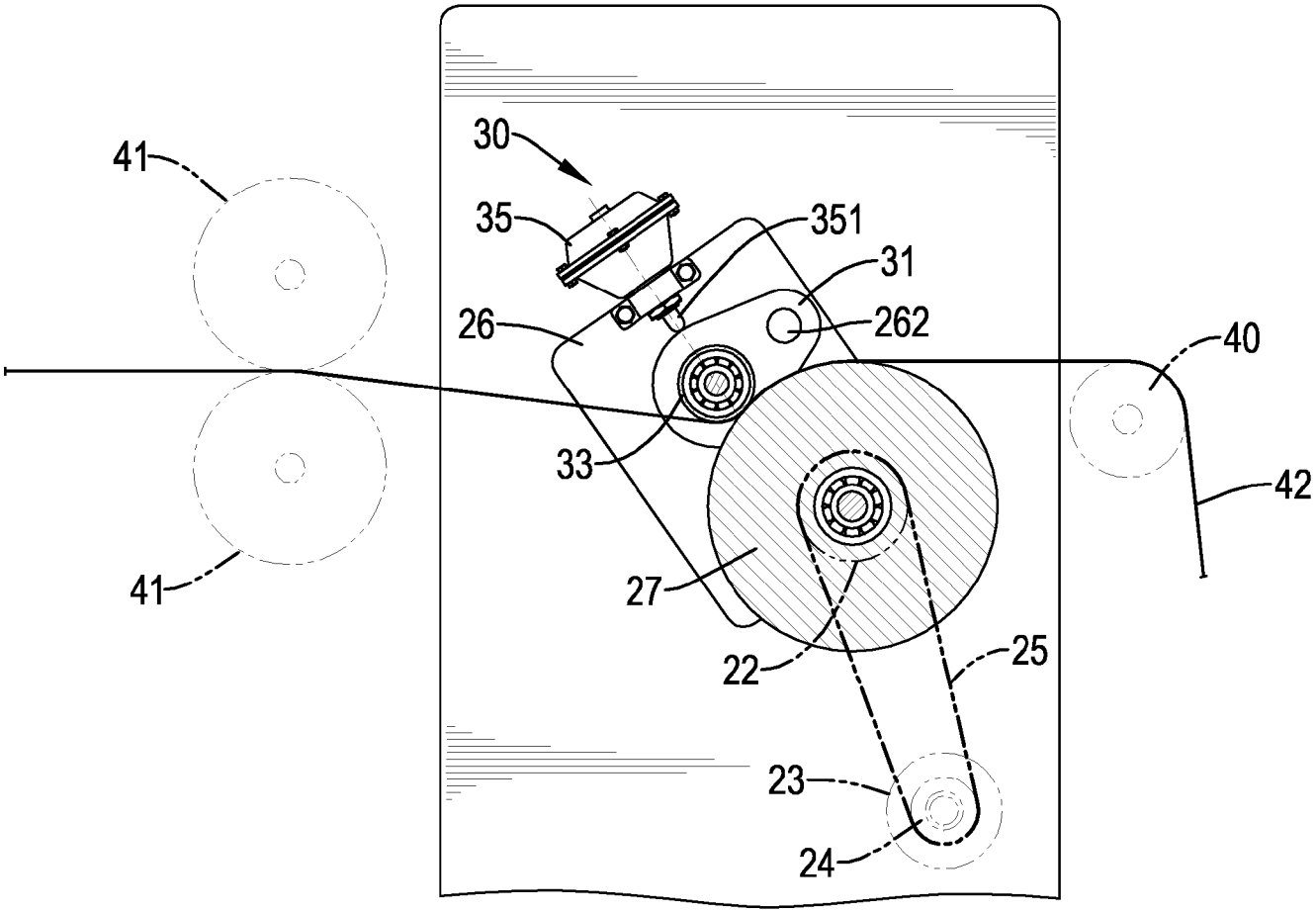
FIG. 4 is a side view in partial section of the leveling machine for rolled-up tablets in FIG. 1.
Figure 5:
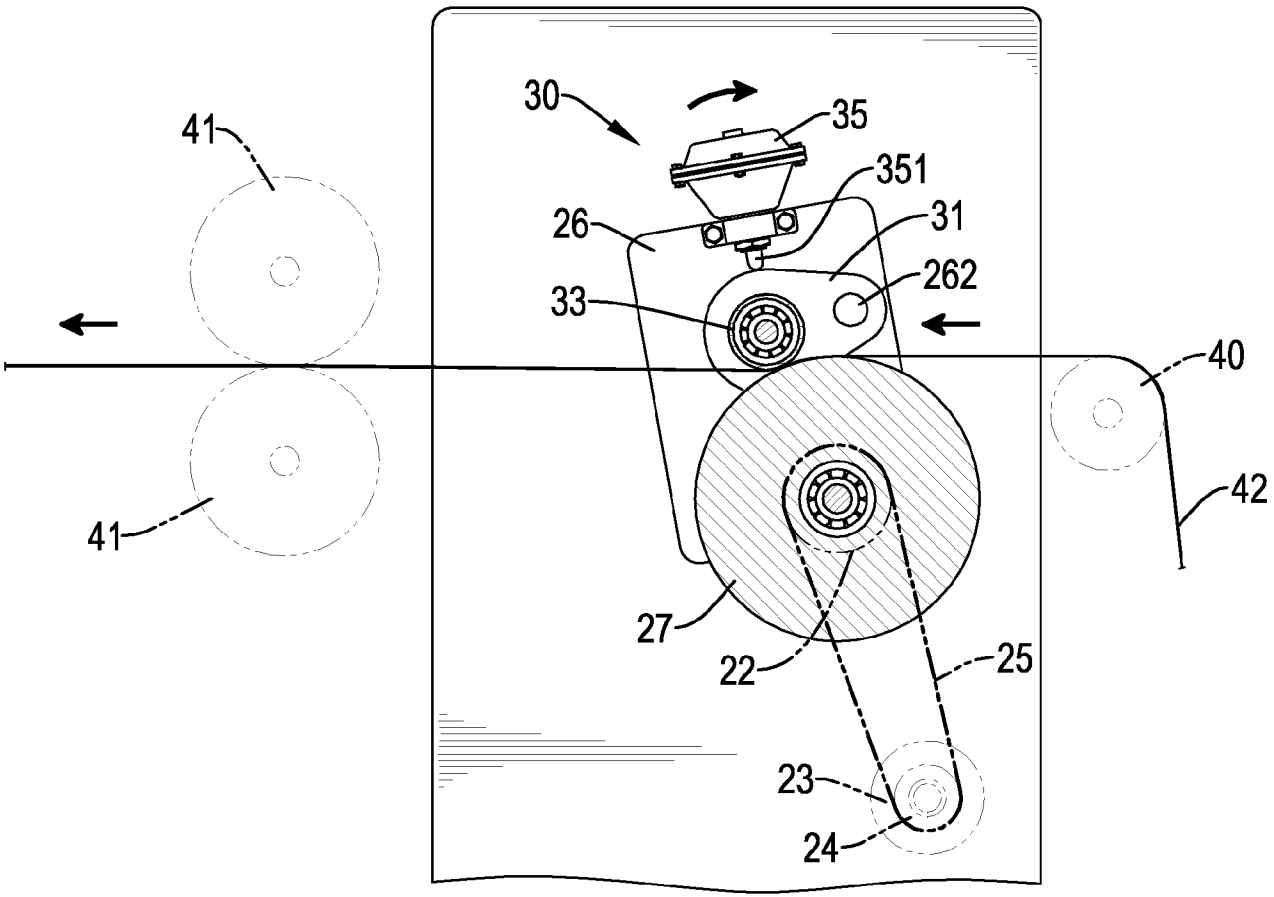
FIG. 5 is an operational side view in partial section of the leveling machine for rolled-up tablets in FIG. 1.
Figure 8:
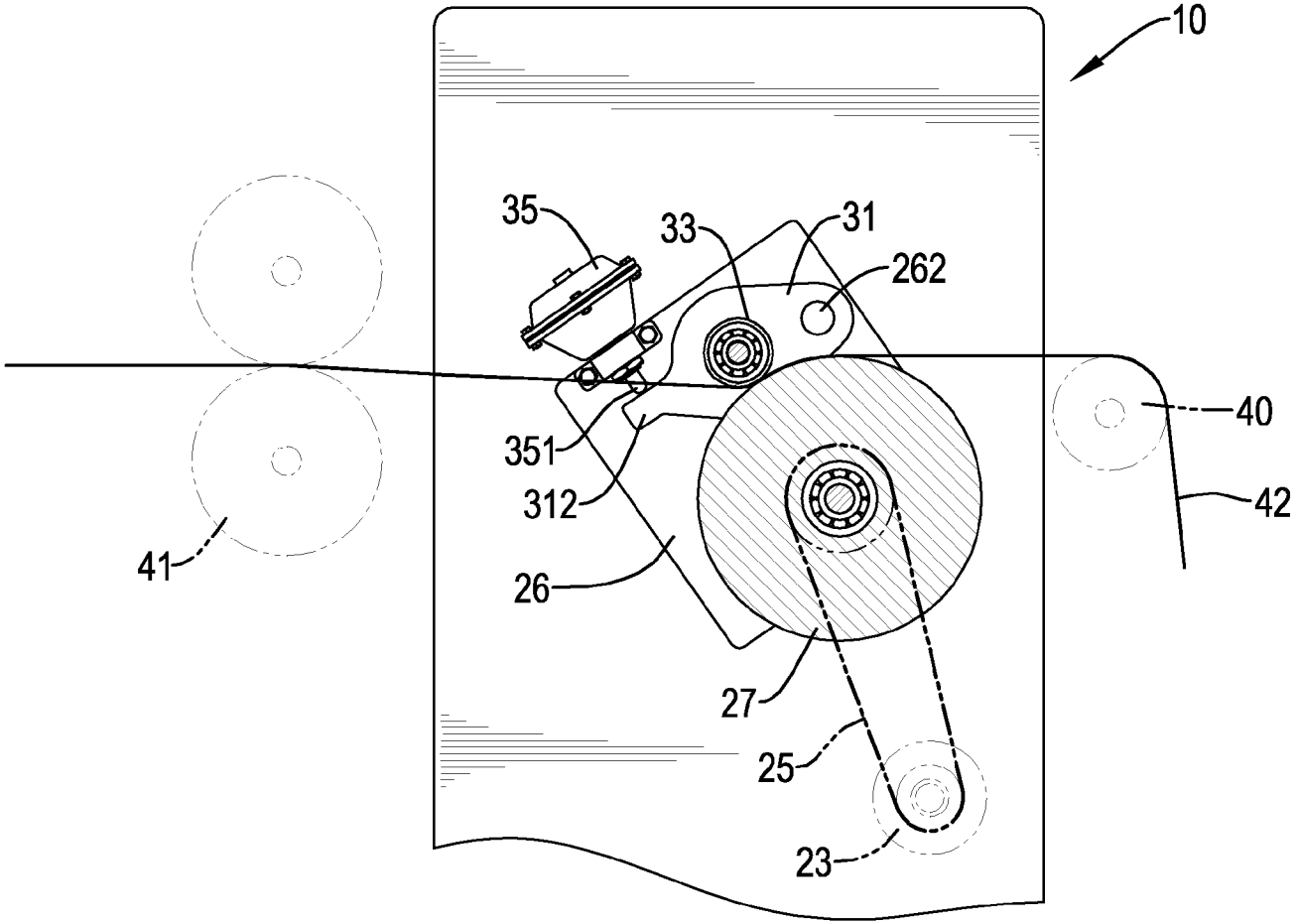
FIG. 8 is a side view in partial section of the leveling machine for rolled-up tablets in FIG. 6.

With reference to FIGS. 4 and 8, when the level machine in accordance with the present invention is used to level a rolled-up tablet 42 with a high rolled-up degree, the adjusting motor 23 is driven to rotate the spindle 21 via the driving belt pulley 24, the belt 25 and the adjusting belt pulley 22 to enable the mounting boards 26 to oscillate backwardly. Then, the top cylinders 33 are moved backwardly to away from the center of the bottom cylinder 27, and the rolled-up tablet 42 with a high rolled-up degree can be pressed between the top cylinders 33 and the bottom cylinder 27 with a high reversed clamping force and this can provide a preferred leveling effect to the rolled-up tablet 42.

Figure 9:
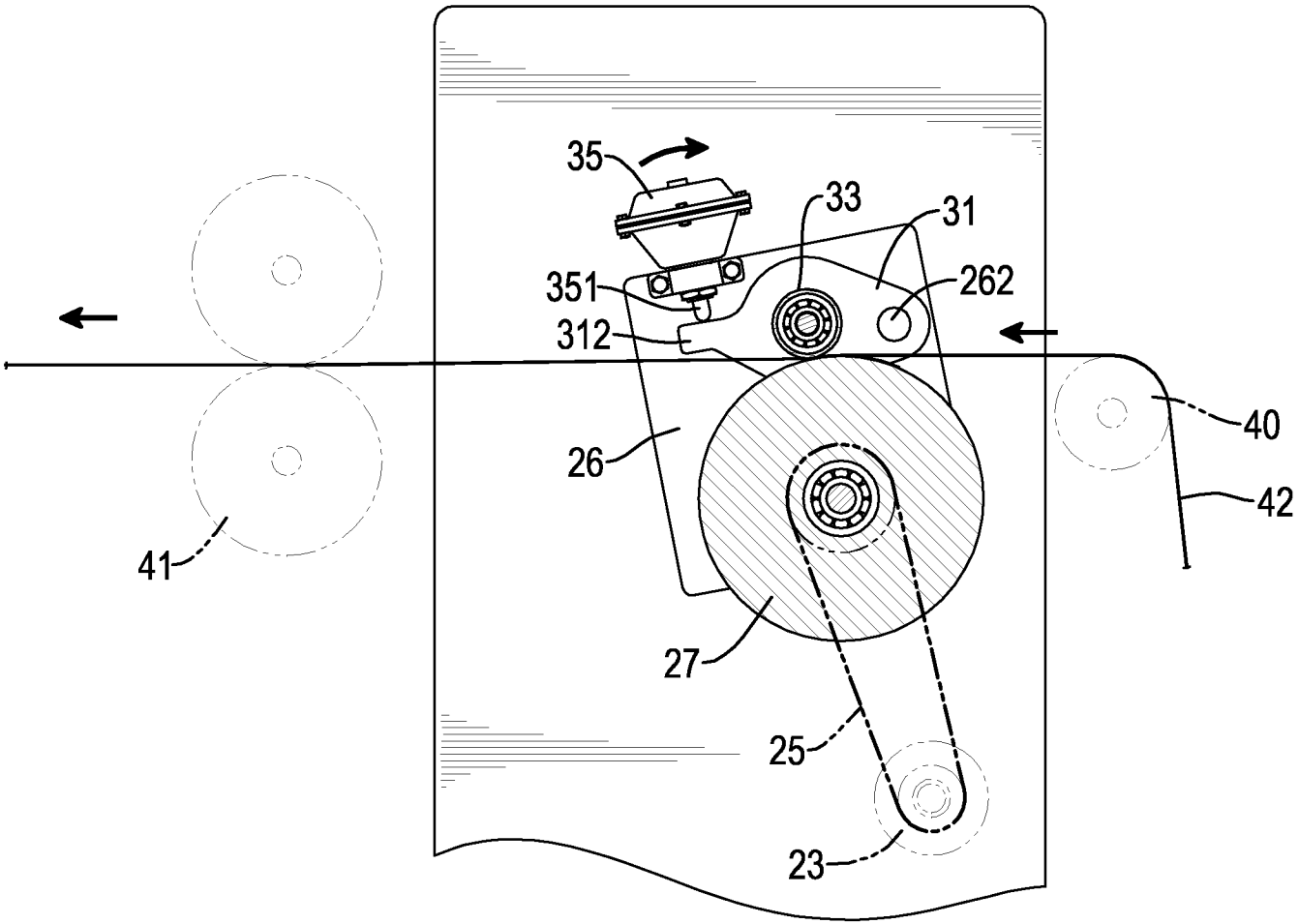
FIG. 9 is an operational side view in partial section of the leveling machine for rolled-up tablets in FIG. 6.

In addition, with reference to FIGS. 8 and 9, in the second embodiment of the leveling machine in accordance with the present invention, the abutting rods 351 of the telescopic drivers 35 are respectively pressed the lever segments 312 of the top cylinder mounts 31, and the distance between the position of the abutting rod 351 abuts the lever segment 312 and the corresponding oscillating rod 262 is longer than the distance between the cylinder axle 32 and the oscillating rod 262. Then, the abutting rods 351 can provide larger moments to push the lever segments 312 to enable the top cylinders 33 to press the bottom cylinder 27 closely and easily.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A leveling machine for rolled-up tablets comprising a base having two sideboards facing to each other at an interval and each sideboard having an inner side facing to each other;

an outer side; and a spindle hole formed through the sideboard and aligning with the spindle hole of the other sideboard;

a mounting frame rotatably mounted in the base between the sideboards and having a spindle rotatably mounted in the spindle holes of the sideboards and having two ends and one of the ends of the spindle extending out of the outer side of a corresponding sideboard;

an adjusting motor mounted securely on one of the sideboards below the spindle to drive the spindle;

two mounting boards respectively, obliquely and securely mounted around the spindle near the inner sides of the sideboards, and each mounting board having a bottom;

a top; and an inner side facing to the inner side of the other mounting board; and a bottom cylinder rotatably mounted around the spindle between the mounting boards; and a wheel-leveling device connected to the mounting frame and having two top cylinder mounts being noncircular and respectively and rotatably mounted on the mounting boards, and each cylinder mount having a front end;

a rear end;

an outer side mounted around a corresponding board at the front end of the cylinder mount to enable the cylinder mount to extend to the bottom cylinder; and an inner side; and an annular surface;

a cylinder axle connected to the inner sides of the top cylinder mounts at the rear ends over the bottom cylinder;

a top cylinder rotatably mounted around the cylinder axle, selectively abutting the bottom cylinder;

two pushing mounts respectively mounted on the inner sides of the mounting boards at the tops of the mounting boards, and each pushing mount having a top and a bottom; and two telescopic drivers respectively and securely mounted on the tops of the pushing mounts, and each telescopic driver having a bottom; and an abutting rod movably mounted on the bottom of the telescopic driver, extending out of the bottom of a corresponding pushing mount and abutting the annular surface of a corresponding cylinder mount at rear end to enable the top cylinder to abut the bottom cylinder.

2. The leveling machine for rolled-up tablets as claimed in claim 1, wherein each mounting board has a mounting hole formed through the mounting board near the bottom of the mounting bard and securely mounted around the spindle; and an oscillating rod formed on and protruding from the inner side of the mounting board near the top of the mounting boards and aligning with the oscillating rod of the other mounting board; and each cylinder mount is rotatably mounted on the oscillating rod of a corresponding mounting board and has a rod hole formed in the outer side of the cylinder mount at the front end and mounted around the oscillating rod of the corresponding mounting board to enable the rear end of the cylinder mount to extend to the bottom cylinder;

the bottom cylinder has a diameter; and the top cylinder has a diameter smaller than the diameter of the bottom cylinder.

3. The leveling machine for rolled-up tablets as claimed in claim 2, wherein the top cylinder has an axle center; and an imaginary line extending along the axle center of the top cylinder; and the abutting rod of each telescopic driver has an imaginary line that extending along the abutting rod passing through the imaginary line of the top cylinder.

4. The leveling machine for rolled-up tablets as claimed in claim 2, wherein each cylinder mount further has a lever segment formed on and protruding from the rear end of the cylinder mount and abutting the abutting rod of a corresponding telescopic driver to enable the top cylinder to press against the bottom cylinder.

5. The leveling machine for rolled-up tablets as claimed in claim 3, wherein the adjusting motor has a driving axle extending out of the corresponding sideboard below the end of the spindle that extends out of the corresponding sideboard; and the mounting frame has an adjusting belt pulley mounted around the end of the spindle that extends out of the corresponding sideboard;

a driving belt pulley mounted around the driving axle of the adjusting motor below the adjusting belt pulley; and a belt mounted around the belt pulleys to enable the adjusting motor to drive the spindle.

* * * * *